US007430851B2

(12) United States Patent
Patwari

(10) Patent No.: US 7,430,851 B2
(45) Date of Patent: Oct. 7, 2008

(54) AIR AND FUEL VENTING DEVICE FOR FUEL INJECTOR NOZZLE TIP

(75) Inventor: Kiran Patwari, Highland Heights, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 441 days.

(21) Appl. No.: 11/220,142

(22) Filed: Sep. 6, 2005

(65) Prior Publication Data

US 2006/0156732 A1 Jul. 20, 2006

Related U.S. Application Data

(60) Provisional application No. 60/644,655, filed on Jan. 18, 2005.

(51) Int. Cl.
*F02C 7/22* (2006.01)

(52) U.S. Cl. ..... 60/39.094; 60/740

(58) Field of Classification Search ..... 60/39.091, 60/39.094, 740, 742; 239/110, 111, 120; 431/117

See application file for complete search history.

(56) References Cited

U.S. PATENT DOCUMENTS 4,198,815 A 4/1980 Bobo et al.
4,850,194 A 7/1989 Fuglistaller et al.
5,085,040 A 2/1992 Tilston
5,417,054 A * 5/1995 Lee et al. ..... 60/39.094
5,615,555 A 4/1997 Mina
5,701,732 A * 12/1997 Nesbitt et al. ..... 60/39.094
6,019,596 A 2/2000 Knopfel et al.
6,073,436 A * 6/2000 Bell et al. ..... 60/39.094
2005/0160738 A1 * 7/2005 Fish et al. ..... 60/776

* cited by examiner

*Primary Examiner*—L. J. Casaregola
(74) *Attorney, Agent, or Firm*—Christopher H. Hunter

(57) ABSTRACT

In a fuel injector assembly, for an internal combustion engine such as a gas turbine engine, a generally cylindrical air transfer sleeve is, in one embodiment, juxtaposed around a shroud, the sleeve having a peripheral inner recessed cavity, the outer end thereof encompassing a plurality of air inlets and the inner end thereof having a plurality of air openings connecting the cavity with tertiary air for a positive air wash, or in another embodiment, is located intermediate a fuel body and the shroud while having such inner radial dimensions so as to maintain first and second fuel/air venting gaps, with the transfer sleeve also having a peripheral outer recessed cavity wherein the inner end thereof encompasses the air inlets, with an outer end thereof being provided with a plurality of air openings, these openings connecting the recessed cavity with the first fuel/air gap downstream of a restrictor.

33 Claims, 3 Drawing Sheets

AIR AND FUEL VENTING DEVICE FOR FUEL INJECTOR NOZZLE TIP

CROSS-REFERENCE TO RELATED CASES

The present application claims the benefit of the filing date of U.S. Provisional Application Ser. No. 60/644,655; filed Jan. 18, 2005, the disclosure of which is expressly incorporated herein by reference.

FIELD OF THE INVENTION

The present invention generally relates to fuel injectors, and more particularly, to fuel injectors nozzle tips having air transfer sleeves that direct fluid leakage, if any, away from each nozzle tertiary, into the combustion chambers of internal combustion engines, such as gas turbines.

BACKGROUND OF THE INVENTION

Fuel injector assemblies are useful for such applications as a gas turbine combustion engines for directing pressurized fuel from a manifold to one or more combustion chambers. Such assemblies also function to prepare the fuel for mixing with air prior to combustion. Each such injector assembly has an inlet fitting connected to a manifold, a tubular extension or stem connected at one end to a fitting in a typically manifold, a tubular extension or stem connected at one end to a fitting in a typically cantilevered fashion, and one or more spray nozzles or nozzle tips connected to the other end of the stem or housing for directing the fuel into the combustion chamber. A single or multiple fuel feed circuits extend through the housing to supply fuel from the inlet fitting to the nozzle or nozzle assembly.

In a typical fuel nozzle, active fuel flow passages are surrounded by an insulation cavity, or tertiary, to prevent excessive heat transfer. Such a fuel nozzle insulation cavity is only partially sealed since a completely sealed fuel cavity, if there is any leakage of fuel from the associated braze joints or O-ring seals, upon absorbing surrounding heat, can cause structural breakdowns or even a possible explosion. Typically, vents are provided to prevent such undesired high pressure buildups, generally via an annular gap between the nozzle shroud and the fuel body which functions to transfer the leaked fuel and/or fuel/air mixture downstream of the combustion liner. However, due to the nature of the transient aerodynamics, air pressure in the tertiary can be lower than the pressure at the vent exit and, as a result, there can be undesired backflow of the combustion products, fuel and fuel/air mixture from the combustor into the tertiary. In order to prevent such backflow, a positive air wash is typically used and backflow is usually prevented. However it cannot be guaranteed that the tertiary pressure is always lower than that of the compressor discharged air and thus it is possible that the noted leaked fluids can actually escape from the air wash inlet holes rather than flowing to the vent exit. The present invention addresses this unsolved problem.

An attempted prior art solution is set forth in U.S. Pat. No. 5,615,555 to Mina, which discloses a fuel injector for a gas turbine with means to prevent flashback. The utilized injector includes an outer shroud that forms an annular passage for directing compressed air towards the downstream end thereof and to additionally direct fuel spillage from purging holes toward the downstream end thereof. However, this proposed solution more closely resembles the existing state of the art and thus retains the noted described weaknesses. Specifically, gas fuel in chamber 1 can flow upstream through an aperture 17 in some transient situations. The present invention minimizes this potential via a pneumatic resistance of an air transfer sleeve.

While U.S. Pat. No. 4,198,815 to Bobo et al. pertains to air assisted fuel atomization, it is otherwise not relevant to the present invention.

SUMMARY OF THE INVENTION

Accordingly, in order to overcome the deficiencies of prior art devices, the present invention provides several devices or structures that fluid leakage, if any, from the nozzle tertiary, is directed into the engine combustor.

Specifically, in a fuel injector assembly, for dispensing fuel in the combustion chamber of a gas turbine engine, having a fuel nozzle tip within a fuel insulating cavity that is only partially sealed so as to permit an emergency fuel leakage path, the nozzle tip comprises in combination: a. a generally cylindrical fuel body; b. a generally cylindrical shroud juxtaposed around the fuel body; c. a peripheral emergency fuel venting gap, of a predetermined radial extent, between the fuel body and the shroud, near the inner ends thereof; d. the emergency fuel venting gap merging into a peripheral emergency first fuel/air venting gap, the shroud including a plurality of peripherally spaced air inlets, for providing tertiary air for a positive air wash into the first fuel/air venting gap; e. a peripheral restrictor, within the first fuel/air venting gap, downstream of the plurality of air inlets, for temporarily narrowing the radial extent of the first fuel/air venting gap; f. the first fuel/air venting gap merging into a peripheral emergency second fuel/air venting gap, downstream of the first fuel/air venting gap, the second fuel/air venting gap, near the outer ends of the fuel body and the shroud, being adapted to channel a fuel/air mixture to a vent exit of the nozzle tip downstream of a combustion liner that radially adjoins the shroud; and g. a generally cylindrical air transfer sleeve, intermediate the fuel body and the shroud, of a radial inner dimension so as to maintain the first and second fuel/air venting gaps, the air transfer sleeve having a peripheral outer recessed cavity, the inner end thereof encompassing the plurality of air inlets in the shroud, and an outer end thereof being provided with a plurality of air openings, the air openings connecting the recessed cavity with the first fuel/air venting gap in the area downstream of the restrictor.

In one variation thereof, the plurality of peripherally spaced air inlets, in the shroud, is substantially radially directed. In another variation, the air inlets are one of substantially normal and inclined relative to the peripheral emergency fuel venting gap, with the air inlets being generally equally peripherally spaced.

In a further variation, the plurality of air openings, in the air transfer sleeve, is generally equally peripherally spaced and the air openings are substantially radially directed. In a differing variation, the air openings are one of substantially normal and inclined relative to the first fuel/air gap. Preferably, the air transfer sleeve is received within a generally cylindrical inner recess in the shroud.

Yet another variation, the air transfer sleeve further includes a radially inwardly directed band portion, the band portion, together with a spaced, radially adjacent portion of the fuel body, defining the second fuel/air gap.

In still a differing variation, an inner peripheral portion of the shroud, together with the peripheral outer recessed cavity, in the air transfer sleeve, defines a peripheral air gap for the tertiary air for the positive air wash.

In another embodiment of this invention, in a fuel injector assembly, for dispensing fuel in the combustion chamber of a gas turbine engine, having a fuel nozzle tip within a fuel insulating cavity that is only partially sealed so as to permit an emergency fuel leakage path, the nozzle tip comprises in combination: a. a generally cylindrical fuel body; b. a generally cylindrical shroud juxtaposed around the fuel body; c. a peripheral emergency fuel venting gap, of a predetermined radial extent, between the fuel body and the shroud, near the inner ends thereof; d. the emergency fuel venting gap merging into a peripheral emergency first fuel/air venting gap, the shroud including a plurality of peripherally spaced air inlets, for providing tertiary air for a positive air wash into the first fuel/air venting gap; e. a peripheral restrictor, separating the emergency fuel venting gap and the first fuel/air venting gap, upstream of the plurality of air inlets, for narrowing the radial extent of the emergency fuel venting gap; f. the first fuel/air venting gap merging into a peripheral emergency second fuel/air venting gap, downstream of the first fuel/air venting gap, the second fuel/air venting gap, near the outer ends of the fuel body and the shroud, being adapted to channel a fuel/air mixture to a vent exit of the nozzle tip downstream of a combustion liner that radially adjoins the shroud; and g. a generally cylindrical air transfer sleeve, juxtaposed around the shroud, the air transfer sleeve having a peripheral inner recessed cavity, the outer end thereof encompassing the plurality of air inlets in the shroud, and an inner end thereof being provided with a plurality of air openings, the air openings connecting the recessed cavity with tertiary air for the positive air wash.

In a variation thereof, the plurality of peripherally spaced air inlets, in the shroud, is substantially radially directed. In a differing variation, the air inlets are one of substantially normal and inclined relative to the first fuel/air venting gap and are generally equally peripherally spaced.

In another variation, the plurality of air openings, in the air transfer sleeve is generally equally peripherally spaced. The air openings are either substantially radially directed or are one of substantially normal and inclined relative to the peripheral inner recessed cavity in the air transfer sleeve.

In a further variation, the peripheral inner recessed cavity, in the air transfer sleeve, together with a first outer peripheral surface portion of the shroud, defines a peripheral air gap for the tertiary air for the positive air wash.

Yet another variation, further includes a third fuel/air venting gap between a second outer peripheral portion the shroud, axially spaced from the first peripheral surface portion thereof, and a radially adjacent inner peripheral portion of the air transfer sleeve, axially spaced from the recessed cavity. Preferably, the third fuel/air venting gap is substantially coaxial with the second fuel/air venting gap. In addition, an annular end surface of the air transfer sleeve is attached to an annular surface of the shroud.

In a further embodiment of this invention, in a fuel injector assembly, for dispensing fuel in the combustion chamber of a gas turbine engine, having a nozzle tip within a fuel insulating cavity that is only partially sealed so as to permit an emergency fuel leakage path, the nozzle tip comprises in combination: a. a generally cylindrical fuel body; b. a generally cylindrical shroud juxtaposed around the fuel body; c. a peripheral emergency fuel venting gap, of a predetermined radial extent, between the fuel body and the shroud, near the inner ends thereof; d. the emergency fuel venting gap merging into a peripheral emergency first fuel/air venting gap, the shroud including a plurality of peripherally spaced air inlets, for providing tertiary air for a positive air wash into the first fuel/air venting gap; e. a peripheral restrictor, being one of upstream and downstream of the plurality of air inlets, for one of narrowing the radial extent of the emergency fuel venting gap and temporarily narrowing the radial extent of the first fuel/air venting gap; f. the first fuel/air venting gap merging into a peripheral emergency second fuel/air venting gap, downstream of the first fuel/air venting gap, the second fuel/air venting gap, near the outer ends of the fuel body and the shroud, being adapted to channel a fuel/air mixture to a vent exit of the nozzle tip downstream of a combustion liner that radially adjoins the shroud: and g. a generally cylindrical air transfer sleeve, being one of juxtaposed around the shroud, the air transfer sleeve having a peripheral inner recessed cavity, the outer end thereof encompassing the plurality of air inlets, with an inner end thereof being provided with a plurality of air openings, the air openings connecting the recessed cavity with tertiary air for the positive air wash, and being located intermediate the fuel body and the shroud, having such inner radial dimensions so as to maintain the first and second fuel/air venting gaps, the air transfer sleeve having a peripheral outer recessed cavity, the inner end thereof encompassing the plurality of air inlets, and an outer end thereof being provided with a plurality of air openings, the air openings connecting the recessed cavity with the first fuel/air venting gap in the area downstream of the restrictor.

In a variation thereof, the pluralities of peripherally spaced air inlets and air openings are substantially radially directed and are generally equally peripherally spaced.

In another variation, the air inlets are one of substantially normal and inclined relative to one of the peripheral emergency fuel venting gap and the first fuel/air venting gap. Similarly, the air openings are one of substantially normal and inclined relative to one of the first fuel/air venting gap and the peripheral inner recessed cavity in the air transfer sleeve.

In a further variation, an inner peripheral portion of the shroud, together with the peripheral outer recessed cavity, in the air transfer sleeve, defines a peripheral air gap for the tertiary air for the positive air wash.

A differing variation further includes a radially inwardly directed band portion, the band portion, together with a spaced, radially adjacent portion of the fuel body, defining the second fuel/air gap.

In an additional variation, the peripheral inner recessed cavity, in the air transfer sleeve, together with a first outer peripheral surface portion of the shroud, defines a peripheral air gap for the tertiary air for the positive air wash.

Yet another variation further includes a third fuel/air venting gap between a second outer peripheral portion of the shroud, axially spaced from the first peripheral surface portion thereof, and a radially adjacent inner peripheral portion of the air transfer sleeve, axially spaced from the recessed cavity, with the third fuel/air venting gap preferably being substantially coaxial with the second fuel air venting gap.

In still a differing variation, the air transfer sleeve is substantially coaxial with the shroud and is preferably attached to one of the outer and inner peripheral surfaces of the shroud.

DETAILED DESCRIPTION OF THE PREFERRED EMBODIMENTS

Figure 1:
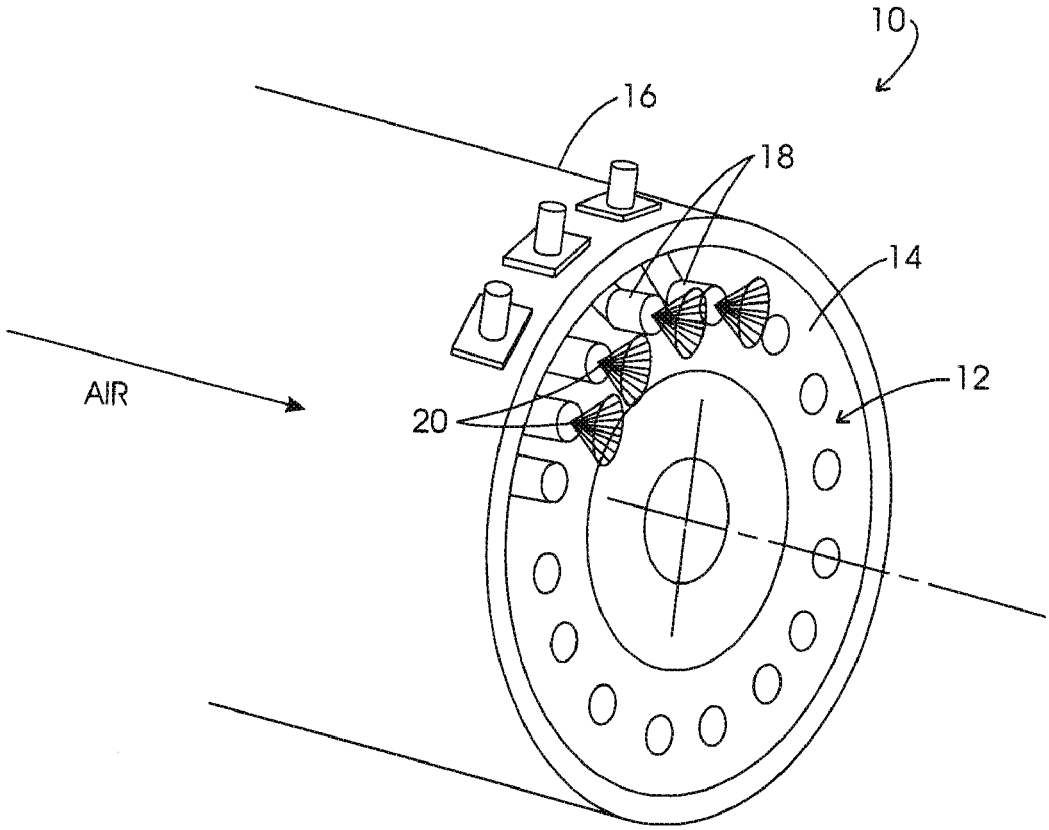
FIG. 1 is a schematic and greatly simplified cross-sectional view of a gas turbine engine combustion chamber, utilizing fuel injector assemblies having the air and fuel venting devices for the fuel injector nozzle tips, constructed according to the principles of the present invention.

Referring now to the several drawings, and initially to FIG. 1, a schematic and greatly simplified portion of a gas turbine engine is generally indicated at 10. The upstream, front wall 14 of a combustion chamber 12, for engine 10, is located near one end of an engine casing 16. A plurality of fuel injector assemblies 18, each utilizing the air and fuel venting device (hereinafter "A/FVD") 22 (not shown in FIG. 1), constructed in accordance to the principles of the present invention, at each of their fuel injector nozzle tips 20. Combustion chamber 12 is a typical combustion chamber for aircraft applications, and thus will not be discussed further for the sake of brevity. The fuel injector assemblies 18 atomize and direct fuel into combustion chamber 12 for ignition. A compressor (not shown) is mounted upstream of fuel injectors or fuel injector assemblies 18 and provides pressurized air, at elevated temperatures, for combustion chamber 12, to facilitate the ignition process. The noted air is typically provided at highly elevated temperatures, which can reach over 1000 degrees F. in aircraft applications.

While the A/FVDs 22 of the present invention are particularly useful in gas turbine engines for aircraft, these A/FVDs are also deemed to be useful in other types of turbine engine applications, including, but not limited to, industrial power generating equipment and in marine propulsion applications.

Figure 2:
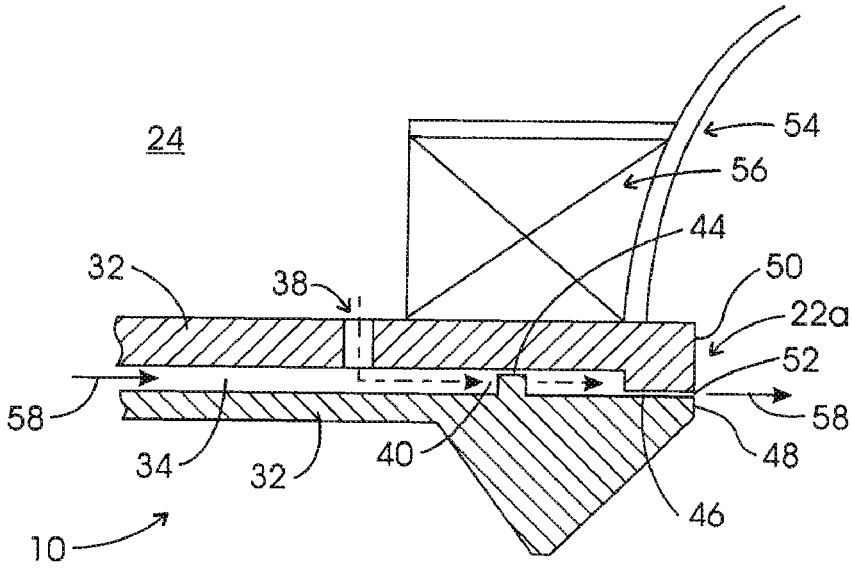
FIG. 2 PRIOR ART
FIG. 2 is a schematic and simplified partial cross-sectional view of a prior art air and fuel venting device for use with fuel injector nozzle tips.

Turning now particularly to FIG. 2, illustrated therein is a simplified, partial, cross section of a prior art A/FVD 22*a* for use with a typical fuel nozzle tip 20. It should be understood that in fuel injector nozzle tips such as 20, the fuel insulation cavity 24, generally denominated as "tertiary", is not completely sealed. The reason for this is that if there is any leakage of fuel from any of the braze joints or O-ring seals, that are utilized therein, a completely sealed fuel cavity 24, upon absorbing heat from the surrounding area, could experience an explosions or structural breakdowns of the housing. Thus, it is more typical that vents are provided so as to prevent the buildup of such undesired high pressures.

As specifically shown in FIG. 2, juxtaposed around a generally cylindrical a fuel body 30 is an adjoining peripheral shroud 32. Interposed therebetween is a peripheral, generally cylindrical, emergency fuel venting gap 34, of a predetermined radial thickness or height. A plurality of radially directed air inlets 38 in shroud 32, generally in the form of four to eight preferably equally peripherally spaced apertures, normal or inclined to gap 34, extend into and permit air to enter fuel venting gap 34, which now seamlessly continues as first air/fuel venting gap 40. Located axially downstream of air inlets 38, within first air/fuel venting gap 40, is a peripheral restrictor 44, that temporarily narrows the radial extent of gap 40. Axially downstream of restrictor 44, first air/fuel venting gap 40 is again reduced in radial extent or thickness to a second air/fuel venting gap 46 that extends between the outer end of gap 40 and an exit 52 at the proximate or outer annular ends 48 and 50 of fuel body 30 and shroud 32, respectively. Second air/fuel venting gap 46 thus channels the vented fuel mixture downstream of a combustion liner 54 that radially adjoins shroud 32, with combustion liner 54 having an axially adjacent air swirler 56. Thus, as described, the exit of the vented fuel mixture occurs via annular second air/fuel gap 46 between nozzle shroud 32 and fuel body 30.

However, this approach suffers from the difficulty that, due to the nature of the transient aerodynamics, the air pressure in tertiary 24 can be lower than the air pressure at exit 52 of gap 46. As a result, there can be a backflow of the combustion products and fuel from the combustor or combustion chamber 12 into tertiary 24. In order to prevent this backflow, a positive air wash is typically utilized via the plurality of air inlets 38 that allow compressor discharged air flow into fuel venting gap 40 and continue axially outwardly via first and second air/fuel venting gaps 40, 46, respectively, into combustor downstream of liner 54. Since, during normal operation, there is a pressure drop of about 4 to 5% between the compressor discharged air and the air downstream of liner 54, the direction of the air wash, indicated by a plurality of successive arrows 58 in gaps 34, 40 and 46, this backflow of combustion products and fuel is usually prevented. However the prior art arrangement, as shown in FIG. 2, has resulted in unacceptable operational deficiencies in the past. The nature of aerodynamic transients is not fully predictable and it cannot be stated with certainty that the tertiary pressure is always going to be lower than that of the compressor discharged air. Thus, it is possible that leaked fuel can actually escape from the noted air inlet holes or apertures 38 rather than flow to vent exit 52. During at least one such occurrence, the resulting fuel smell reached even into the vehicle cockpit.

Figure 3:
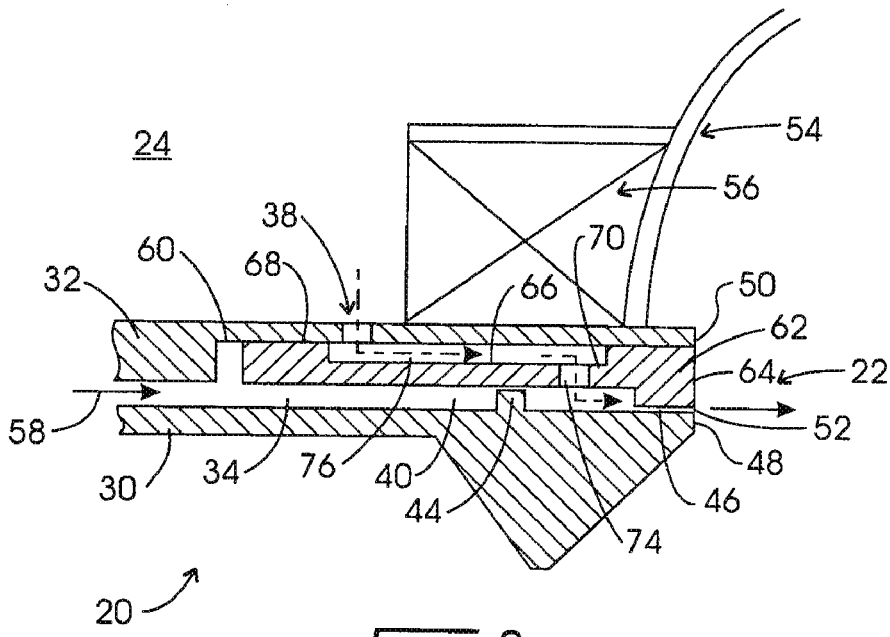
FIG. 3 is a schematic and simplified partial cross-sectional view of a first embodiment of the air and fuel venting device of the present invention.

Turning now to a first embodiment 22 of the A/FVD of the present invention, in FIG. 3, in the interest of simplicity, like numerals are utilized for like parts, relative to FIG. 2. A generally cylindrical air transfer sleeve 62 is attached, such as via brazing or welding, to a peripheral, cylindrical relieved inner area 60 at the proximate end of shroud 32, with the outer annular end surface 64 of sleeve 62 being coplanar with annular ends 48 and 50 of fuel body 30 and shroud 32, respectively. Air transfer sleeve 62 includes a peripheral, cylindrical outer recessed area 66, the inner end 68 of which encompasses or overlays the circumferentially spaced plurality of air inlets 38. An outer end 70 of air transfer sleeve 62 includes a plurality of radially directed air openings 74, generally in the form of four to eight preferably equally circumferentially spaced apertures or holes, normal or inclined to first air/fuel gap 40 in the area of gap 40 that is located between restrictor 44 and second air/fuel venting gap 46, close to vent exit 52.

Thus, outer recessed area 66 of air transfer sleeve 62, together with inner relieved area 60 of shroud 32, defines an annular air gap 76 therebetween. The compressor discharged air enters air gap 76, via the noted plurality of shroud air inlet holes 38, and emanates therefrom, via the noted plurality of air transfer sleeve air openings 74, into first air/fuel venting gap 40, near second air/fuel venting gap 46, which in turn is axially very close to the latter's exit end 52. Thus, the air wash thereafter emanates through exit end 52 into combustor 12. However, in case of aerodynamic transients, in which the tertiary pressure is higher than that of the compressor discharged air, the fuel cannot escape from shroud inlet holes 38 in the manner shown in the structure of prior art FIG. 2, due to the added obstruction of air transfer sleeve 62. Rather, to escape upstream of shroud air inlet holes 38, the fuel must now first enter air transfer sleeve air gap openings 74 and then travel axially upstream against the movement of the air wash. The probability of this axial upstream travel of the fuel is greatly minimized since air gap openings 74 are in the proximity of exit end 52, where the pressure is lower than that of the compressor discharged air. As is well known, since fluid takes the path of least resistance, the leaked fuel will flow from exit end 52 rather than travel the more tortuous path, through air transfer sleeve 62, against the air wash of compressor discharged air.

Figure 4:
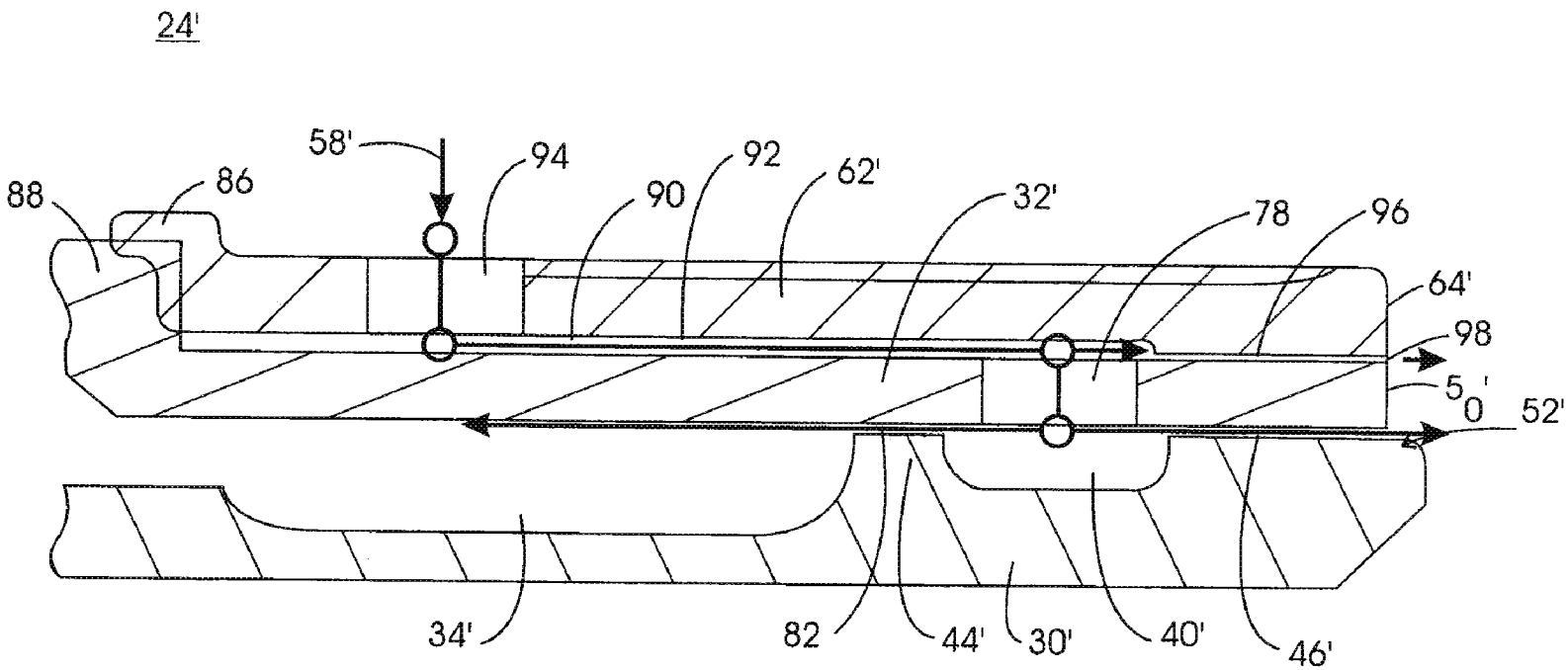
FIG. 4 is a schematic and simplified partial cross-sectional view of a second embodiment of the air and fuel venting device of the present invention.

FIG. 4 is a schematic and simplified partial cross sectional view of a second embodiment 22' of the A/FVD of the present invention. Again in the interest of simplicity, like numerals, with the addition of a prime (') symbol, are utilized for like parts relative to FIGS. 2 and 3.

Continuing specifically with FIG. 4, juxtaposed around a generally cylindrical fuel body 30' is an adjoining peripheral, generally cylindrical shroud 32', with these two structures being generally parallel and radially separated from each other via a predetermined radial thickness or height, generally akin to customary clearance sizing, incurring minimal pressure drop or restriction, so as to define an emergency fuel venting gap 34' therebetween. A plurality of radially directed air openings 78, generally in the form of four to eight preferably equally circumferentially spaced apertures or holes, normal to the axial extent of shroud 32', extend therethrough. Air openings 78 are situated in the area of a first air/fuel venting gap 40' that is located between an upstream restrictor 44', positioned between gaps 34' and 40' and a second air/fuel venting gap 46' extending between shroud 32' and fuel body 30'. Venting gap 46' axially extends from the outer end of venting gap 40' and terminates at an exit end 52' situated at a closely adjacent proximate or outer end 50' of shroud 32'. It should be understood at this time that restrictor 44', together with the opposing portion of shroud 32' defines a narrow or constricted portion 82 that joins venting gaps 34' and 40'. Immediately downstream of the location of air openings 78', venting gap 40 is again reduced in radial extent or thickness as it merges into second air/fuel venting gap 46'.

Circumferentially surrounding the axial outer portion of shroud 32' is an air transfer sleeve 62' whose axial inner end 86 is fixedly attached to a tapered portion 88 of shroud 32', as best seen in FIG. 4, although attachment of sleeve 62', to shroud 32', could also be provided at its axial outer end, etc. Air sleeve 62' is provided with a relieved peripheral inner surface portion 90 that axially extends from its inner end 86 to encompass or surround shroud 32' up to and including the latter's plurality of air openings 78, thus defining an annular air gap 92 therebetween. Air sleeve 62', in the vicinity of its axial inner end 86 is provided with a plurality of radially directed air inlets 94, generally in the form of four to eight preferably equally peripherally spaced apertures, normal to the axial extent of air sleeve 62'. A further annular air gap 96 extends from shroud air openings 78 to air sleeve outer end 64', with the radial extent of air gap 96 again being akin to customary clearance sizing.

Compressor discharged air enters air gap 92, via the noted plurality of air inlets 94 and emanates therefrom, via the plurality of shroud air openings 78, into first air/fuel venting gap 40', near second air/fuel venting gap 46', which in turn is axially very close to the latter's exit end 52'. Thus, the fuel/air mixture thereafter emanates through exit end 52' into combustor 12' in the manner and with the benefits already previously described relative to the operation of A/FVD 22 shown in FIG. 3. In addition, the structure of A/FVD **22*a* of FIG. 4 also permits the fuel/air mixture to emanate, via further air gap 96, at its exit end 98, into combustor 12'**.

It is deemed that one of ordinary skill in the art will readily recognize that the present invention fills remaining needs in this art and will be able to affect various changes, substitutions of equivalents and various other aspects of the invention as described herein. Thus, it is intended that the protection granted hereon be limited only by the scope of the appended claims and their equivalents.

What is claimed is:

1. In a fuel injector assembly, for dispensing fuel in the combustion chamber of a gas turbine engine, having a fuel nozzle tip within a fuel insulating cavity that is only partially sealed so as to permit an emergency fuel leakage path, said nozzle tip comprising in combination:

a. a generally cylindrical fuel body;

b. a generally cylindrical shroud juxtaposed around said fuel body;

c. a peripheral emergency fuel venting gap, of a predetermined radial extent, between said fuel body and said shroud, near the inner ends thereof;

d. said emergency fuel venting gap merging into a peripheral emergency first fuel/air venting gap, said shroud including a plurality of peripherally spaced air inlets, for providing tertiary air for a positive air wash into said first fuel/air venting gap;

e. a peripheral restrictor, within said first fuel/air venting gap, downstream of said plurality of air inlets, for temporarily narrowing the radial extent of said first fuel/air venting gap;

f. said first fuel/air venting gap merging into a peripheral emergency second fuel/air venting gap, downstream of said first fuel/air venting gap, said second fuel/air venting gap, near the outer ends of said fuel body and said shroud, being adapted to channel a fuel/air mixture to a vent exit of said nozzle tip downstream of a combustion liner that radially adjoins said shroud; and g. a generally cylindrical air transfer sleeve, intermediate said fuel body and said shroud, of a radial inner dimension so as to maintain said first and second fuel/air venting gaps, said air transfer sleeve having a peripheral outer recessed cavity, the inner end thereof encompassing said plurality of air inlets in said shroud, and an outer end thereof being provided with a plurality of air openings, said air openings connecting said recessed cavity with said first fuel/air venting gap in the area downstream of said restrictor.

2. The nozzle tip of claim 1, wherein said plurality of peripherally spaced air inlets, in said shroud, is substantially radially directed.

3. The nozzle tip of claim 1, wherein said air inlets are one of substantially normal and inclined relative to said peripheral emergency fuel venting gap.

4. The nozzle tip of claim 2, wherein said air inlets are generally equally peripherally spaced.

5. The nozzle tip of claim 1, wherein said plurality of air openings, in said air transfer sleeve, is generally equally peripherally spaced.

6. The nozzle tip of claim 5, wherein said air openings are substantially radially directed.

7. The nozzle tip of claim 6, wherein said air openings are one of substantially normal and inclined relative to said first fuel/air gap.

8. The nozzle tip of claim 1, wherein said air transfer sleeve is received within a generally cylindrical inner recess in said shroud.

9. In the nozzle tip of claim 1, said air transfer sleeve further including a radially inwardly directed band portion, said band portion, together with a spaced, radially adjacent portion of said fuel body, defining said second fuel/air gap.

10. The nozzle tip of claim 1, wherein an inner peripheral portion of said shroud, together with said peripheral outer recessed cavity, in said air transfer sleeve, defines a peripheral air gap for said tertiary air for said positive air wash.

11. In a fuel injector assembly, for dispensing fuel in the combustion chamber of a gas turbine engine, having a fuel nozzle tip within a fuel insulating cavity that is only partially sealed so as to permit an emergency fuel leakage path, said nozzle tip comprising in combination:

a. a generally cylindrical fuel body;

b. a generally cylindrical shroud juxtaposed around said fuel body;

c. a peripheral emergency fuel venting gap, of a predetermined radial extent, between said fuel body and said shroud, near the inner ends thereof;

d. said emergency fuel venting gap merging into a peripheral emergency first fuel/air venting gap, said shroud including a plurality of peripherally spaced air inlets, for providing tertiary air for a positive air wash into said first fuel/air venting gap;

e. a peripheral restrictor, separating said emergency fuel venting gap and said first fuel/air venting gap, upstream of said plurality of air inlets, for narrowing the radial extent of said emergency fuel venting gap;

f. said first fuel/air venting gap merging into a peripheral emergency second fuel/air venting gap, downstream of said first fuel/air venting gap, said second fuel/air venting gap, near the outer ends of said fuel body and said shroud, being adapted to channel a fuel/air mixture to a vent exit of said nozzle tip downstream of a combustion liner that radially adjoins said shroud; and g. a generally cylindrical air transfer sleeve, juxtaposed around said shroud, said air transfer sleeve having a peripheral inner recessed cavity, the outer end thereof encompassing said plurality of air inlets in said shroud, and an inner end thereof being provided with a plurality of air openings, said air openings connecting said recessed cavity with tertiary air for said positive air wash.

12. The nozzle tip of claim 11, wherein said plurality of peripherally spaced air inlets, in said shroud, is substantially radially directed.

13. The nozzle tip of claim 11, wherein said air inlets are one of substantially normal and inclined relative to said first fuel/air venting gap.

14. The nozzle tip of claim 12, wherein said air inlets are generally equally peripherally spaced.

15. The nozzle tip of claim 11, wherein said plurality of air openings, in said air transfer sleeve is generally equally peripherally spaced.

16. The nozzle tip of claim 15, wherein said air openings are substantially radially directed.

17. The nozzle tip of claim 16, wherein said air openings are one of substantially normal and inclined relative to said peripheral inner recessed cavity in said air transfer sleeve.

18. The nozzle tip of claim 11, wherein said peripheral inner recessed cavity, in said air transfer sleeve, together with a first outer peripheral surface portion of said shroud, defines a peripheral air gap for said tertiary air for said positive air wash.

19. The nozzle tip of claim 11, further including a third fuel/air venting gap between a second outer peripheral portion said shroud, axially spaced from said first peripheral surface portion thereof, and a radially adjacent inner peripheral portion of said air transfer sleeve, axially spaced from said recessed cavity.

20. The nozzle tip of claim 19, wherein said third fuel/air venting gap is substantially coaxial with said second fuel/air venting gap.

21. The nozzle tip of claim 11, wherein an annular end surface of said air transfer sleeve is attached to an annular surface of said shroud.

22. In a fuel injector assembly, for dispensing fuel in the combustion chamber of a gas turbine engine, having a nozzle tip within a fuel insulating cavity that is only partially sealed so as to permit an emergency fuel leakage path, said nozzle tip comprising in combination:

a. a generally cylindrical fuel body;

b. a generally cylindrical shroud juxtaposed around said fuel body;

c. a peripheral emergency fuel venting gap, of a predetermined radial extent, between said fuel body and said shroud, near the inner ends thereof;

d. said emergency fuel venting gap merging into a peripheral emergency first fuel/air venting gap, said shroud including a plurality of peripherally spaced air inlets, for providing tertiary air for a positive air wash into said first fuel/air venting gap;

e. a peripheral restrictor, being one of upstream and downstream of said plurality of air inlets, for one of narrowing the radial extent of said emergency fuel venting gap and temporarily narrowing the radial extent of said first fuel/air venting gap;

f. said first fuel/air venting gap merging into a peripheral emergency second fuel/air venting gap, downstream of said first fuel/air venting gap, said second fuel/air venting gap, near the outer ends of said fuel body and said shroud, being adapted to channel a fuel/air mixture to a vent exit of said nozzle tip downstream of a combustion liner that radially adjoins said shroud: and g. a generally cylindrical air transfer sleeve, being one of juxtaposed around said shroud, said air transfer sleeve having a peripheral inner recessed cavity, the outer end thereof encompassing said plurality of air inlets, with an inner end thereof being provided with a plurality of air openings, said air openings connecting said recessed cavity with tertiary air for said positive air wash, and being located intermediate said fuel body and said shroud, having such inner radial dimensions so as to maintain said first and second fuel/air venting gaps, said air transfer sleeve having a peripheral outer recessed cavity, the inner end thereof encompassing said plurality of air inlets, and an outer end thereof being provided with a plurality of air openings, said air openings connecting said recessed cavity with said first fuel/air venting gap in the area downstream of said restrictor.

23. The nozzle tip of claim 22, wherein said pluralities of peripherally spaced air inlets and air openings are substantially radially directed.

24. The nozzle tip of claim 23, wherein said pluralities of air inlets and air openings are generally equally peripherally spaced.

25. The nozzle tip of claim 22, wherein said air inlets are one of substantially normal and inclined relative to one of said peripheral emergency fuel venting gap and said first fuel/air venting gap.

26. The nozzle tip of claim 22, wherein said air openings are one of substantially normal and inclined relative to one of said first fuel/air venting gap and said peripheral inner recessed cavity in said air transfer sleeve.

27. The nozzle tip of claim 22, wherein an inner peripheral portion of said shroud, together with said peripheral outer recessed cavity, in said air transfer sleeve, defines a peripheral air gap for said tertiary air for said positive air wash.

28. The nozzle tip of claim 22, further including a radially inwardly directed band portion, said band portion, together with a spaced, radially adjacent portion of said fuel body, defining said second fuel/air gap.

29. The nozzle tip of claim 22, wherein said peripheral inner recessed cavity, in said air transfer sleeve, together with a first outer peripheral surface portion of said shroud, defines a peripheral air gap for said tertiary air for said positive air wash.

30. The nozzle tip of claim 22, further including a third fuel/air venting gap between a second outer peripheral portion of said shroud, axially spaced from said first peripheral surface portion thereof, and a radially adjacent inner peripheral portion of said air transfer sleeve, axially spaced from said recessed cavity.

31. The nozzle tip of claim 30, wherein said third fuel/air venting gap is substantially coaxial with said second fuel air venting gap.

32. The nozzle tip of claim 22, wherein said air transfer sleeve is substantially coaxial with said shroud.

33. The nozzle tip of claim 22, wherein said air transfer sleeve is attached to one of said outer and inner peripheral surfaces of said shroud.

* * * * *